US010070700B1

(12) United States Patent
Chen et al.

(10) Patent No.: US 10,070,700 B1
(45) Date of Patent: Sep. 11, 2018

(54) LANYARD ADJUSTER

(71) Applicant: Oculus VR, LLC, Menlo Park, CA (US)

(72) Inventors: Yi-Yaun Chen, Seattle, WA (US); Shane Michael Ellis, Bellevue, WA (US)

(73) Assignee: Oculus VR, LLC, Menlo Park, CA (US)

( * ) Notice: Subject to any disclaimer, the term of this patent is extended or adjusted under 35 U.S.C. 154(b) by 0 days.

(21) Appl. No.: 15/693,436

(22) Filed: Aug. 31, 2017

(51) Int. Cl.
*A45F 3/14* (2006.01)
*A44B 11/10* (2006.01)
*A45F 5/00* (2006.01)

(52) U.S. Cl.
CPC ..... *A44B 11/10* (2013.01); *A45F 5/00* (2013.01); *A45F 2005/006* (2013.01)

(58) Field of Classification Search
CPC ... A45F 3/14; A45F 2003/14; A45F 2003/142
USPC ..... 224/258, 257
See application file for complete search history.

(56) References Cited

U.S. PATENT DOCUMENTS 1,637,003 A * 7/1927 Lang ..... G10G 5/00 224/258
4,118,838 A * 10/1978 Schiefer ..... F16L 3/10 24/115 R
4,453,292 A * 6/1984 Bakker ..... F16G 11/101 24/115 G
5,323,514 A * 6/1994 Masuda ..... F16G 11/101 24/115 G
5,361,461 A * 11/1994 Anscher ..... F16G 11/101 24/115 G
5,435,044 A * 7/1995 Ida ..... F16G 11/106 24/115 M
6,029,870 A * 2/2000 Giacona, III ..... A45F 3/14 224/148.6
6,658,704 B2 * 12/2003 Buscart ..... F16G 11/101 24/115 G
7,254,871 B2 * 8/2007 Yoshiguchi ..... F16G 11/101 2/160
D604,199 S * 11/2009 Kolasa ..... D11/218
7,699,664 B2 * 4/2010 Kim ..... H01R 24/58 381/374
9,016,534 B2 * 4/2015 Whitley ..... A45F 5/00 224/254
9,017,296 B2 * 4/2015 Beck ..... A61M 39/28 604/246
9,265,294 B2 * 2/2016 Ellis ..... A41D 1/002
2007/0278265 A1 * 12/2007 Contente ..... A45F 5/00 224/162
2016/0221252 A1 * 8/2016 Ellis ..... A41D 1/002

* cited by examiner

*Primary Examiner* — Brian D Nash
(74) *Attorney, Agent, or Firm* — Fenwick & West LLP

(57) ABSTRACT

Disclosed herein is a lanyard adjuster that adjusts the length of a lanyard that passes through the lanyard adjuster. The lanyard adjuster includes a housing and a plate residing within the housing. The plate includes flanges that couple with locking slots of the housing to achieve a locked configuration. In the locked configuration, the plate contacts and applies a force on segments of the lanyard that passes through the lanyard adjuster. Therefore, the lengths of the lanyard on either side of the lanyard adjuster are fixed. The plate can be further decoupled from the housing to enable adjustment of the lengths of the lanyard on either side of the lanyard adjuster.

16 Claims, 6 Drawing Sheets

160

LANYARD ADJUSTER

CROSS-REFERENCE TO RELATED APPLICATIONS

This application is related to U.S. patent application Ser. No. 15/693,443 filed on Aug. 31, 2017 and U.S. patent application Ser. No. 15/964,732 filed on Apr. 27, 2018.

BACKGROUND

This disclosure generally relates to a lanyard adjuster, and more specifically to a lanyard for adjusting the length of a lanyard.

Lanyards are often used to couple with valuables, such as a handheld controller. Therefore, a lanyard can be used to reduce the likelihood that a valuable is lost or damaged. However, when in use, different lanyards may have different lengths. The different lengths of lanyards can be cumbersome for some users.

SUMMARY

Embodiments relate to a lanyard adjuster that adjusts the length of a lanyard that passes through the lanyard adjuster. The lanyard adjuster includes a housing that the lanyard passes through and a plate that couples with the housing structure to lock the lanyard in place. The housing may include one or more locking slots that a plate interacts with to achieve a locked configuration. When in a locked configuration, the plate contacts and applies a force on the lanyard. Therefore, the lengths of the lanyard on either side of the lanyard adjuster are fixed. The plate can be decoupled from the housing by applying a force on the plate. After decoupling the plate, the lengths of the lanyard on either side of the lanyard adjuster can be adjusted.

DETAILED DESCRIPTION

Figure 1A:
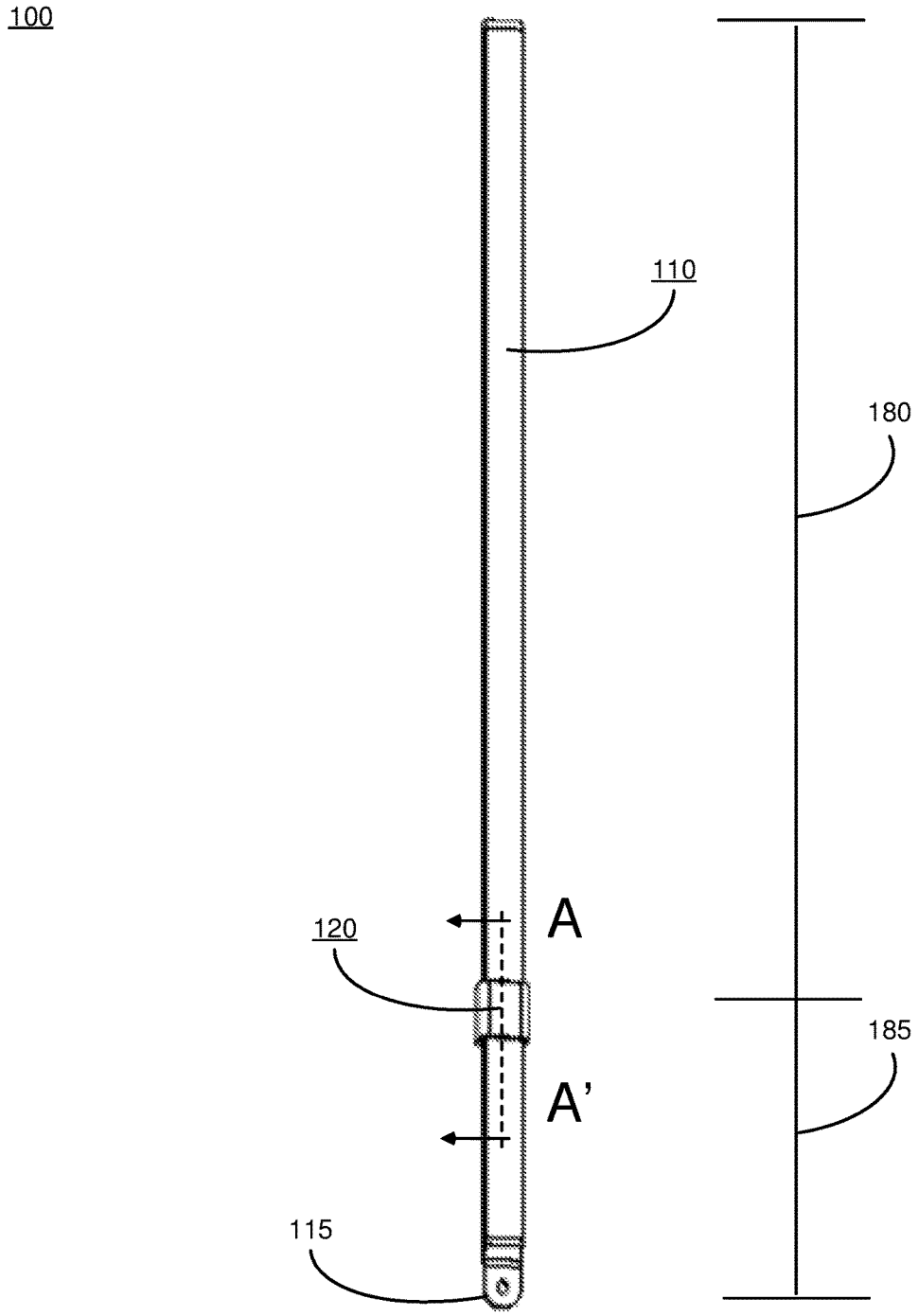
FIG. 1A is an overall view of a lanyard assembly including a lanyard and a lanyard adjuster, in accordance with an embodiment.

Reference will now be made in detail to several embodiments, examples of which are illustrated in the accompanying figures. It is noted that wherever practicable similar or like reference numbers may be used in the figures and may indicate similar or like functionality. For example, a letter after a reference numeral, such as "locking slot 240A," indicates that the text refers specifically to the element having that particular reference numeral. A reference numeral in the text without a following letter, such as "locking slot 240," refers to any or all of the elements in the figures bearing that reference numeral (e.g. "locking slot 240" in the text refers to reference numerals "locking slot 240A" and/or "locking slot 240B" in the figures).

FIG. 1A is an overall view of a lanyard assembly 100 including a lanyard 110 and a lanyard adjuster 120, in accordance with an embodiment. The lanyard adjuster 120 can be coupled with the lanyard 110 and is situated along the length of the lanyard 110. For example, as shown in FIG. 1A, the lanyard adjuster 120 is located along the length of the lanyard 110 such that a first portion 180 of the lanyard 110 is on one side of the lanyard adjuster 120 and a second portion 185 of the lanyard 110 is on a second side of the lanyard adjuster 120. Generally, the lanyard adjuster 120 enables the changing of the lengths of both the first portion 180 and the second portion 185 of the lanyard 110. The end 115 of the lanyard 110 can be configured to couple with a reciprocal structure, such as a handheld controller.

Figure 1B:
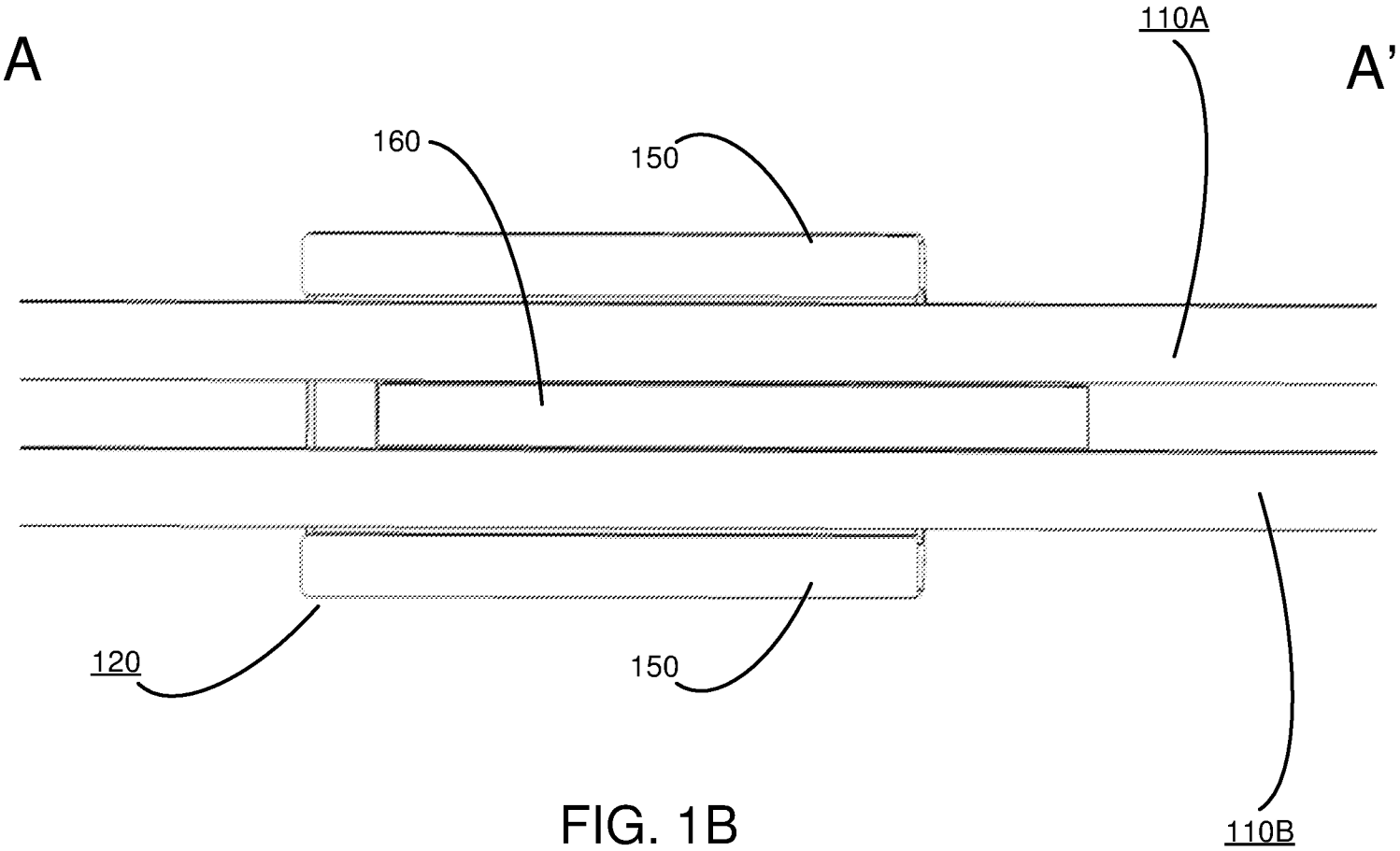
FIG. 1B depicts a cross sectional diagram of the lanyard and lanyard adjuster that illustrates a cross section taken along line A-A' of FIG. 1A, in accordance with an embodiment.

FIG. 1B depicts a cross sectional diagram of the lanyard 110 and lanyard adjuster 120 taken along line A-A' of FIG. 1A, in accordance with an embodiment. The lanyard adjuster 120 may be composed of two separate components including a housing 150 and a plate 160. As shown in FIG. 1B, two segments of the lanyard 110 (e.g., a first segment 110A and a second segment 110B) pass through the housing 150 of the lanyard adjuster 120. The plate 160 of the lanyard adjuster 120 resides between the first segment 110A and second segment 110B of the lanyard 110. In other embodiments, both the first segment 110A and second segment 110B of the lanyard 110 reside on the same side of the plate 160 (e.g., either above or below the plate 160).

In various embodiments, such as the embodiment shown in FIG. 1B, the lanyard adjuster 120 achieves a locked configuration. As shown in FIG. 1B, the plate 160 is coupled with the housing 150 such that the first segment 110A and second segment 110B of the lanyard 110 are each translationally and rotationally affixed relative to the lanyard adjuster 120. In other words, when in the locked configuration, the plate 160 and housing 150 of the lanyard adjuster 120 fix the length of each of the first portion 180 and second portion 185 (see FIG. 1A) of the lanyard 110. To fix the length of the first portion 180 and second portion 185, the plate 160, when coupled to the housing 150, applies upward and downward forces on the first segment 110A and second segment 110B of the lanyard 110, respectively, increasing the friction force between the housing 150 and the segments 110A, 110B. For example, the plate 160 applies an upward force to the first segment 110A of the lanyard 110 which is in contact with the top portion of the housing 150. As such, the top portion of the housing 150 applies an opposite (e.g., downward force) onto the first segment 110A of the lanyard 110. Together, the applied forces on the first segment 110A of the lanyard 110 increases the frictional force applied to the first segment 110A and thereby positionally affix the first segment 110A of the lanyard 110 relative to the lanyard adjuster 120. Similarly, the plate applies downward force to the second segment 110B, which increases the frictional force between the second segment 110B and the housing 150. The increase in the frictional force affixes the second segment 110B to the housing 150. Each of the housing 150 and the plate 160, as well as the features of each that allow them to couple with one another in a locked configuration, are described in further detail below.

Figure 2:
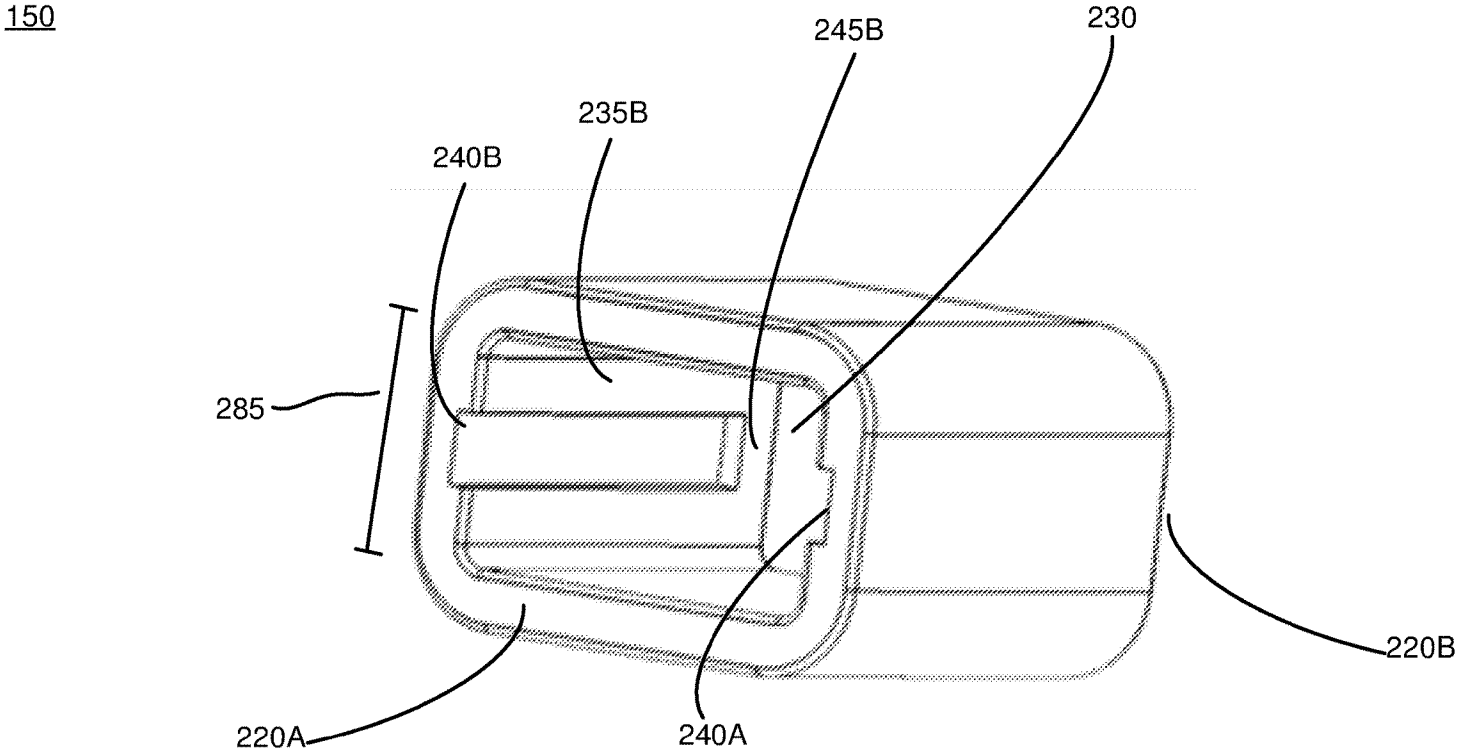
FIG. 2 depicts a perspective view of the housing of the lanyard adjuster, in accordance with an embodiment.

FIG. 2 depicts the housing 150 of the lanyard adjuster, in accordance with an embodiment. As shown in FIG. 2, the housing 150 is a symmetric, hollow cubic structure. Although FIG. 2 depicts the housing 150 as a rectangular prism structure, in other embodiments, the housing 150 can be embodied as a differently shaped structure. For example, the housing 150 may be a flattened rectangular prism such that the length of the rectangular prism runs along the length of the lanyard 110 that enters through the housing 150. In some embodiments, the dimensions of the housing 150 are tailored for the dimensions of the lanyard 110 to reduce the footprint of the housing 150. For example, the width of the housing 150 and the width of the lanyard 110 may have a difference of less than ten percent.

In various embodiments, the housing 150 has a first face 220A, a second face 220B, a center through-hole 230, and a pair of locking slots 240A and 240B that line internal surfaces of the housing 150. The through-hole 230 of the housing 150 is dimensioned and shaped so that a portion of the lanyard 110 can pass through it. As depicted in FIG. 2, the through-hole 230 is rectangular in shape, though the through-hole 230 can be differently shaped. The through-hole 230 defines the internal surfaces of the housing 150 such as internal surface 235B on a side portion of the housing 150. Similarly, the housing 150 can have an internal surface 235A (not shown) on a different side portion of the housing 150. The internal surface 235A can be opposite of the internal surface 235B. Additionally, the housing 150 can have a top internal surface and bottom internal surface.

Referring now to the pair of locking slots 240A and 240B, they enable the housing 150 to couple with the plate 160. In various embodiments, locking slot 240A lines the internal surface 235A and the locking slot 240B lines internal surface 235B that is opposite of the internal surface 235A. In some embodiments, the distance from an internal surface of the top of the housing 150 to a locking slot 240 is equal to the distance from an internal surface of the bottom of the housing 150 to the same locking slot 240. As shown in FIG. 2, locking slots 240 may be indentations in the respective internal surfaces 235A and 235B. Therefore, a reciprocal structure of the plate 160 can enter and couple with each locking slot 240 to ensure that the housing 150 and plate 160 are coupled with one another. Although FIG. 2 depicts the locking slots 240 to be a rectangular indentations, in other embodiments, the locking slots 240 can be differently shaped to accommodate the shape of the reciprocal structure of the plate 160.

Generally, the locking slots 240 extend from a first face 220A of the housing 150 along each respective internal surface 235 but do not extend to the second face 220B of the housing 150. For example, as shown in FIG. 2, locking slot 240B terminates at a detent 245B near the second face 220B of the housing 150. Although not shown, locking slot 240A may similarly terminate at a detent 245A near the second face 220B of the housing 150. In various embodiments, each locking slot 240 may terminate farther or nearer to the second face 220B of the housing 150 than as shown in FIG. 2.

Figure 3:
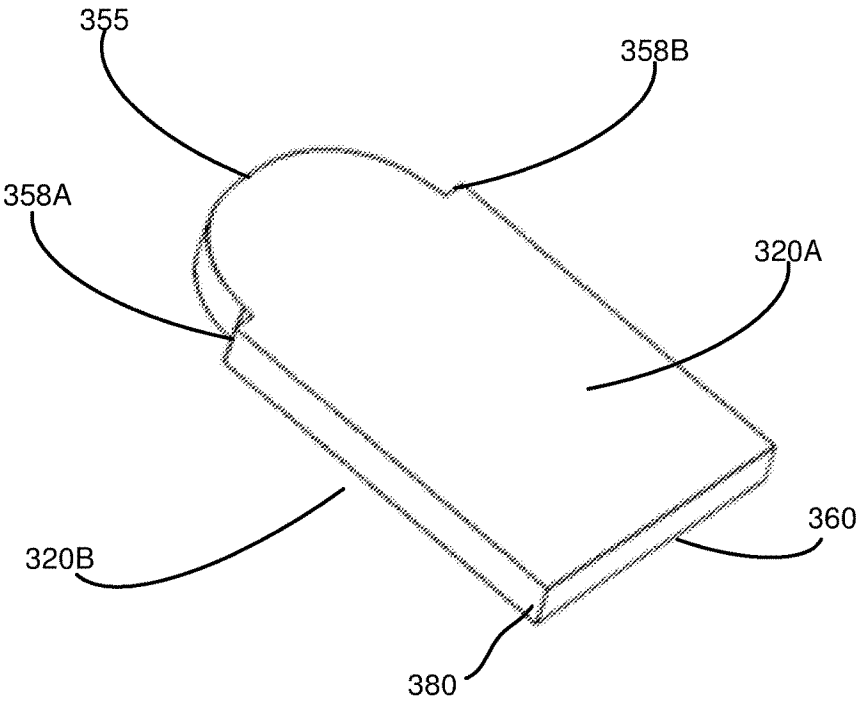
FIG. 3 depicts a perspective view of a plate of the lanyard adjuster, in accordance with an embodiment.

Referring now to FIG. 3, it depicts the plate 160 of the lanyard adjuster 120, in accordance with an embodiment. In various embodiments, the plate 160 is symmetrical along at least one axis of the plate 160. The plate 160 may be constructed of any one of metal, plastic (e.g., polypropylene or polyethylene), ceramic, composite material, glass, and the like. The plate 160 may have a thickness 380 as shown in FIG. 3. In various embodiments, the thickness 380 of the plate 160 is smaller than the height 285 of the through-hole 230 (see FIG. 2) such that the plate 160 can enter into the through-hole 230.

The plate 160 may have a first end 355, a second end 360, a top face 320A, a bottom face 320B, as well as one or more flanges 358A and 358B. As shown in FIG. 3 the length of the first end 355 is shorter than the length of the second end 360. In various embodiments, the first end 355 is curved. For example, the first end 355 may be a hemispherical curve. The second end 360 of the plate 160 can be differently configured in comparison to the first end 355. For example, as shown in FIG. 3, the second end 360 of the plate 160 can be a flat edge. This enables the easy differentiation between the first end 355 and second end 360 of the plate 160.

The flanges 358A and 358B of the plate 160 are located along the length of the plate 160 between the first end 355 and second end 360. Generally, the flanges 358 enable the plate 160 to couple with the housing 150. Specifically, each flange 358 enters and couples with a corresponding locking slot 240, as discussed above in relation to FIG. 2. As shown in FIG. 3, the flanges 358 protrude outwardly away from the curved first end 355. Therefore, the distance from flange 358A to flange 358B is longer than the length of the first end 355 of the plate 160. In some embodiments, the distance from flange 358A to flange 358B is equal to the length of the second end 360 of the plate 160. Each flange 358 is depicted as having a rectangular face, though in other embodiments, each flange 358 can be differently designed to couple with the locking slot 240 of the housing 150. In some embodiments, the length of the first end 355 is longer than the length of the second end 360. In this scenario, the distance from the flange 358A to the flange 358B is shorter than the length of the first end 355.

In various embodiments, each of the top face 320A and bottom face 320B of the plate 160 can be designed with features that increase the surface area of each of the top face 320A and bottom face 320B. This ensures that when the top face 320A and bottom face 320B are respectively in contact with a segment of the lanyard 110 (e.g., first segment 110A and second segment 110B), the features help positionally affix the segment of the lanyard 110 in relation to the plate 160 (and the lanyard adjuster 120). For example, at least a portion of each of the top face 320A and bottom face 320B can include a sawtooth or jagged edge such that the increase in surface area of each face 320 achieves a larger frictional force between each face 320 and the lanyard 110 when in the locked configuration.

Figure 4A:
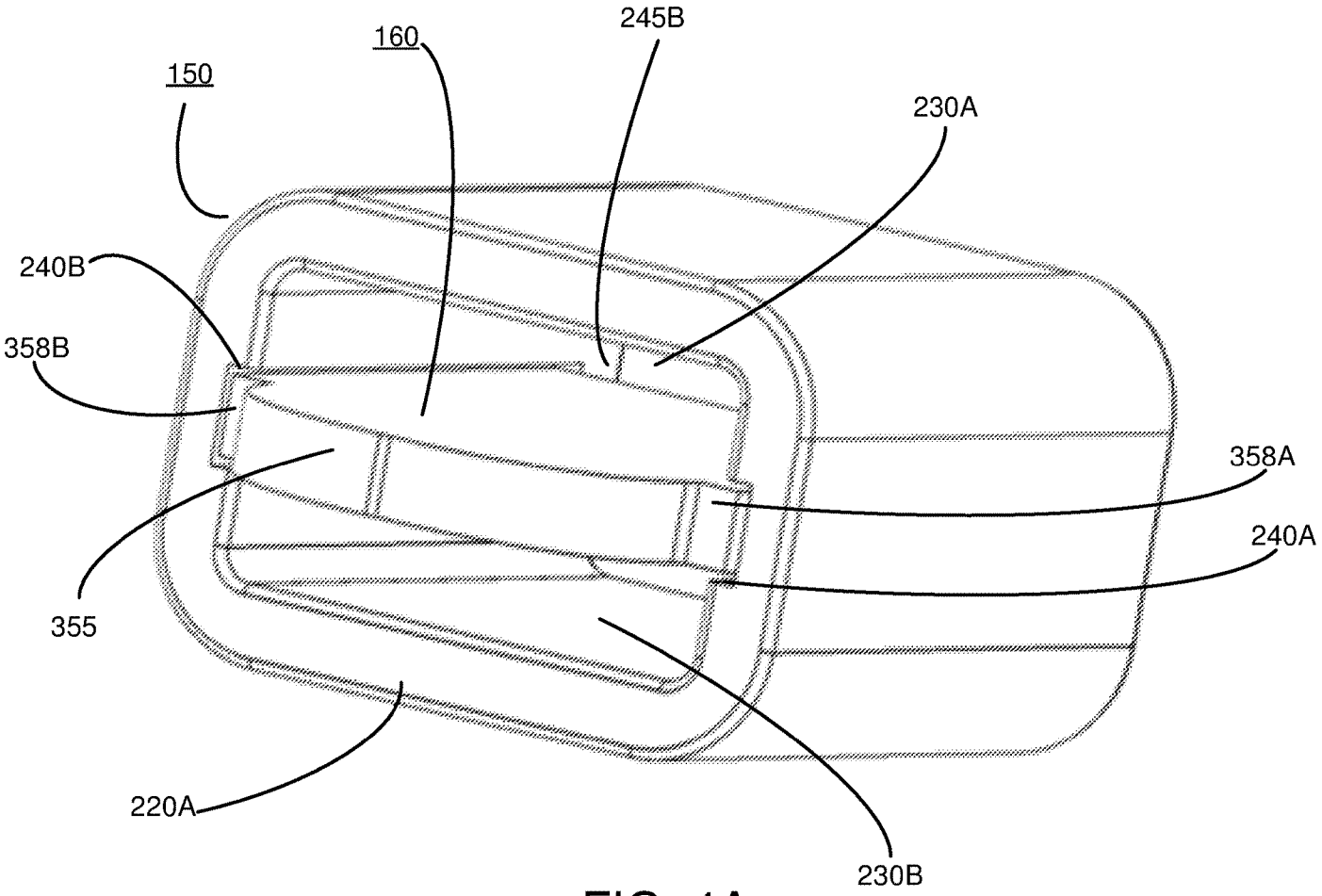
FIG. 4A depicts a front perspective view of the assembled lanyard adjuster, in accordance with an embodiment.

FIG. 4A depicts a front perspective view of the assembled lanyard adjuster, in accordance with an embodiment. Specifically, FIG. 4A depicts the lanyard adjuster 120 in a locked configuration. As described above, the housing 150 and the plate 160, when coupled to each other, fix the lengths of the first portion 180 (see FIG. 1A) of the lanyard 110 relative to the length of the second portion 185 of the lanyard 110. As shown in FIG. 4A, the plate 160 resides within the housing 150 and separates the through-hole 230 into the upper portion 230A and the lower portion 230B. In various embodiments, the plate 160 bisects the through-hole 230 into the upper portion 230A and the lower portion 230B that are equal in height to each other.

To achieve the locked configuration shown in FIG. 4, the plate 160 can be navigated within the housing 150 along the locking slots 240. For example, the second end 360 of the plate 160 can enter into the pair of locking slots 240 and the flanges 358 can slide along the pair of locking slots 240. The plate 160 achieves the locked configuration when the second end 360 of the plate 160 contacts the detents 245 of the housing.

As depicted in FIG. 4A, the first end 355 of the plate 160 is located near the first face 220A of the housing 150 (e.g., the first end 355 of the plate 160 is located more proximal to the first face 220A in comparison to the second end 360 of the plate 160). The second end 360 of the plate 160 is located near the second face 220B of the housing 150 (e.g., the second end 360 of the plate 160 is located more proximal to the second face 220B in comparison to the first end 355 of the plate 160). In various embodiments, when in the locked configuration, the first end 355 of the plate 160 extends outward from the first face 220A of the housing 150. This enables a user to easily grasp the first end 355 of the plate 160.

Figure 4B:
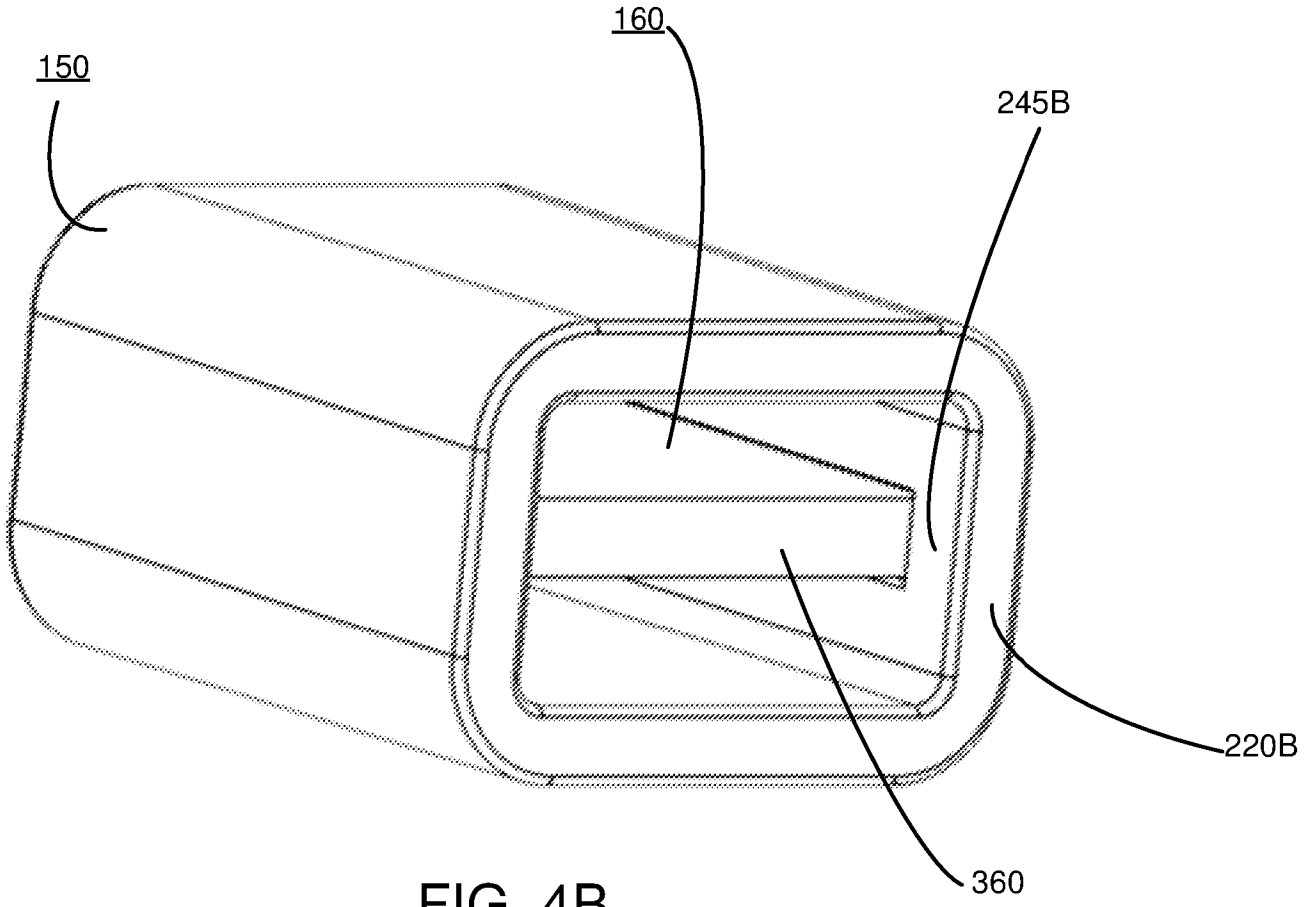
FIG. 4B depicts a back perspective view of the assembled lanyard adjuster, in accordance with an embodiment.

FIG. 4B depicts a back perspective view of the assembled lanyard adjuster 120, in accordance with an embodiment. In particular, FIG. 4B depicts the second end 360 of the plate 160 in contact with the detent 245B (and 245A, not shown) when in the locked configuration. Therefore, when in the locked configuration, the second end 360 of the plate 160 fully resides within the housing 150.

To decouple the plate 160 from the housing 150, the flanges 258 of the plate 160 are dislocated from the locking slots 240 by applying a force on the lanyard adjuster 120. As one example, a force can be imparted on the second end 360 of the plate 160 to push the plate 160 away from the second face 220B of the housing 150. As another example, a twisting force can be applied to the plate 160 to dislodge the flanges 258 from the locking slots 240. In another example, a compressive force can be provided to the top and bottom surfaces of the housing 150 to decouple the flanges 258 from the locking slots 240. When the flanges 258 of the plate 160 are decoupled from the locking slots 240 of the housing 150, the lanyard 110 that passes through the through-hole 230 of the housing 150 is free to move to adjust the lengths of the first segment 110A and second segment 110B of the lanyard 110.

What is claimed is:

1. A lanyard adjuster comprising:

a housing having a top interior surface, a bottom interior surface, a first side interior surface located between the top interior surface and the bottom interior surface, and a second side interior surface located between the top interior surface and the bottom interior surface, the top, bottom, first side, and second side interior surfaces defining a through-hole, a first slot formed on the first side interior surface and a second slot formed on the second interior surface; and a plate configured to be at least partially received in the through-hole of the housing, the plate comprising:

flanges each configured to be received in a corresponding one of the slots to couple the plate with the housing;

a top surface facing a top interior surface of the housing; and a bottom surface at an opposite side of the top surface and facing a bottom interior surface of the housing, at least one of the top surface or the bottom surface configured to press against a segment of a lanyard to fix a position of the lanyard relative to the plate.

2. The lanyard adjuster of claim 1, wherein the plate has a thickness thinner than a height of the through-hole of the housing.

3. The lanyard adjuster of claim 1, wherein the plate and the housing are shaped symmetrically.

4. The lanyard adjuster of claim 3, wherein the first side interior surface and the second side interior surface are opposite interior surfaces.

5. The lanyard adjuster of claim 1, wherein the plate is made of metal and the housing is made of plastic.

6. The lanyard adjuster of claim 1, wherein a distance from the first slot to the top interior surface and a distance from the first slot to the bottom interior surface are equal.

7. The lanyard adjuster of claim 1, wherein the plate further comprises a first end with a curved edge and a second end with a straight edge.

8. The lanyard adjuster of claim 1, wherein each of the top surface of the plate and the bottom surface of the plate are smooth.

9. A lanyard assembly comprising:

a lanyard having a first segment and a second segment; and a lanyard adjuster comprising:

a housing having a top interior surface, a bottom interior surface, a first side interior surface located between the top interior surface and the bottom interior surface, and a second side interior surface located between the top interior surface and the bottom interior surface, the top, bottom, first side, and second side interior surfaces defining a through-hole, a first slot formed on the first side interior surface and a second slot formed on the second interior surface; and a plate configured to be at least partially received in the through-hole of the housing, the plate comprising:

flanges each configured to be received in a corresponding one of the slots to couple the plate with the housing a top surface facing a top interior surface of the housing; and a bottom surface at an opposite side of the top surface and facing a bottom interior surface of the housing, one or both of the first and second segments of the lanyard placed between at least one of the top surface and the top interior surface of the housing or the bottom surface and the bottom interior surface of the housing, the at least one of the top surface or the bottom surface pressing the one or both segments of the lanyard against the top interior surface or bottom interior surface of the housing to fix a position of the lanyard relative to the plate.

10. The lanyard assembly of claim 9, wherein the plate has a thickness thinner than a height of the through-hole of the housing.

11. The lanyard assembly of claim 9, wherein the plate and the housing are shaped symmetrically.

12. The lanyard assembly of claim 11, wherein the first side interior surface and the second side interior surface are opposite interior surfaces.

13. The lanyard assembly of claim 9, wherein the plate is made of metal and the housing is made of plastic.

14. The lanyard assembly of claim 9, wherein a distance from the first slot to the top interior surface and a distance from the first slot to the bottom interior surface are equal.

15. The lanyard assembly of claim 9, wherein the plate further comprises a first end with a curved edge and a second end with a straight edge.

16. The lanyard assembly of claim 9, wherein each of the top surface of the plate and the bottom surface of the plate are smooth.

* * * * *